United States Patent [19]

Tasaki et al.

[11] Patent Number: 4,971,252

[45] Date of Patent: Nov. 20, 1990

[54] NOZZLE CAP

[75] Inventors: Takaharu Tasaki, Funabashi; Tadao Saito, Tokyo, both of Japan

[73] Assignee: Yoshino Kogyosho Co., Ltd., Tokyo, Japan

[21] Appl. No.: 372,112

[22] Filed: Jun. 28, 1989

Related U.S. Application Data

[63] Continuation of Ser. No. 137,350, Dec. 23, 1987, abandoned.

[51] Int. Cl.[5] ..... B05B 1/02

[52] U.S. Cl. ..... 239/428.5; 239/343; 239/432

[58] Field of Search ..... 239/343, 370, 428.5, 239/432, 498, 500, 501, 502, 518

[56] References Cited

U.S. PATENT DOCUMENTS

| | | | |
|---|---|---|---|
| 1,836,505 | 12/1931 | Pritchard | 239/500 |
| 2,075,867 | 4/1937 | Sampel | 239/432 X |
| 2,575,222 | 11/1951 | Isenberg | 239/428.5 |
| 2,577,024 | 12/1951 | Lundberg | 239/343 |
| 2,624,622 | 1/1953 | Holte | 239/343 |
| 3,122,325 | 2/1964 | Mahrt et al. | 239/343 X |
| 3,226,036 | 12/1965 | Grahn | 239/432 X |
| 4,219,159 | 8/1980 | Wesner | 239/428.5 X |
| 4,350,298 | 9/1982 | Tada | 239/343 X |
| 4,646,973 | 3/1987 | Facaracci | 239/428.5 |
| 4,730,775 | 3/1988 | Maas | 239/428.5 X |

FOREIGN PATENT DOCUMENTS

| | | | |
|---|---|---|---|
| 1097410 | 1/1961 | Fed. Rep. of Germany | 239/343 |
| 3442901 | 6/1986 | Fed. Rep. of Germany | 239/343 |
| 1244458 | 9/1960 | France | 239/501 |

*Primary Examiner*—Andres Kashnikow
*Assistant Examiner*—William Grant
*Attorney, Agent, or Firm*—Oliff & Berridge

[57] ABSTRACT

The present invention is a nozzle cap which has a foaming cylinder arranged on the front face of a nozzle port of a nozzle body, wherein an inner peripheral uneven portion is formed on the inner peripheral wall of the foaming cylinder. The uneven portion formed on the inner peripheral wall of the foaming cylinder complicatedly reflects the liquid injected from the nozzle port as compared with a mere cylindrical foaming cylinder to thus effeciently foam the liquid.

13 Claims, 5 Drawing Sheets

NOZZLE CAP

This is a continuation of application Ser. No. 137,350 filed Dec. 23, 1987, abandoned.

BACKGROUND OF THE INVENTION

1. Field of the Invention

The invention relates to a nozzle cap rotatably mounted at the end of the injection cylinder for a trigger type liquid dispenser.

2. Prior Art

A trigger type liquid dispenser operates, as simply shown by an example in FIG. 11, to actuate a piston 2 several times with a trigger 1 to suck liquid from a container, to pull the trigger 1 in this state to press the piston 2 into a pumping chamber to pressurize the interior in the pumping chamber, and to open an exhaust valve by the high pressure liquid to inject the liquid through an injection cylinder 4 and the nozzle port of a cap 5.

The nozzle cap 5 has, as known per se, a liquid guide engaged fixedly with the end of the injection cylinder 4, and a nozzle body rotatably engaged with the end of the liquid guide and opened with a nozzle port at the center therof. The nozzle body can be selected to three types of states of "foam", "direct" and "closure", i.e., injecting the liquid content in a foaming state, injecting the liquid content in a water column state as it is or closing to stop injecting the liquid content, according to the rotating position of the nozzle body.

Heretofore, foaming means has a foaming cylinder arranged on the front face of the nozzle port of the nozzle body. The foaming cylinder is of a mere cylinder which lacks variable reflection of injecting liquid and can not foam the liquid efficiently.

SUMMARY OF THE INVENTION

It is, therefore, a principle object of the present invention to provide a nozzle cap having a foaming cylinder capable of efficiently foaming liquid.

In order to achieve the above and other objects, there is provided according to the present invention a nozzle cap comprising a foaming cylinder 7 arranged on the front face of the nozzle port 6 of a nozzle body **5*a*, wherein an inner peripheral uneven portion 8 is formed on the inner peripheral wall of the foaming cylinder 7**.

The foaming cylinder 7 collides to reflect injected liquid onto the inner peripheral wall to thus involve air in the liquid to foam the liquid. Thus, the inner peripheral uneven portion 8 is formed on the inner peripheral wall of the foaming cylinder 7 to reflect the injected liquid from the nozzle port 6 by the inner peripheral uneven portion 8 as compared with the cylindrical foaming cylinder of merely smooth inner peripheral surface to thus efficiently foam the liquid.

These and other objects and features will become more apparent from the following description of the preferred embodiments of the present invention when read in connection with the accompanying drawings.

DESCRIPTION OF THE PREFERRED EMBODIMENTS

Embodiments of the present invention will now be described in detail with reference to the accompanying drawings. First embodiment of a nozzle cap for a trigger type liquid dispenser according to the present invention will be described by referring to FIGS. 1(A) and 1(B). A nozzle cap 5 comprises a nozzle body **5*a* and liquid guide 5*b*. The liquid guide 5*b* is engaged fixedly with the end of a liquid injection cylinder 4. The nozzle body 5*a* has substantially triangular shape in the front shape. A nozzle port 6 is perforated at the center on the front face of the nozzle body 5*a*. The nozzle body 5*a* is rotatably engaged through a short cylindrical portion 5*c* with a plug 9 at the end of the liquid guide 5*b***.

Figure 1A:
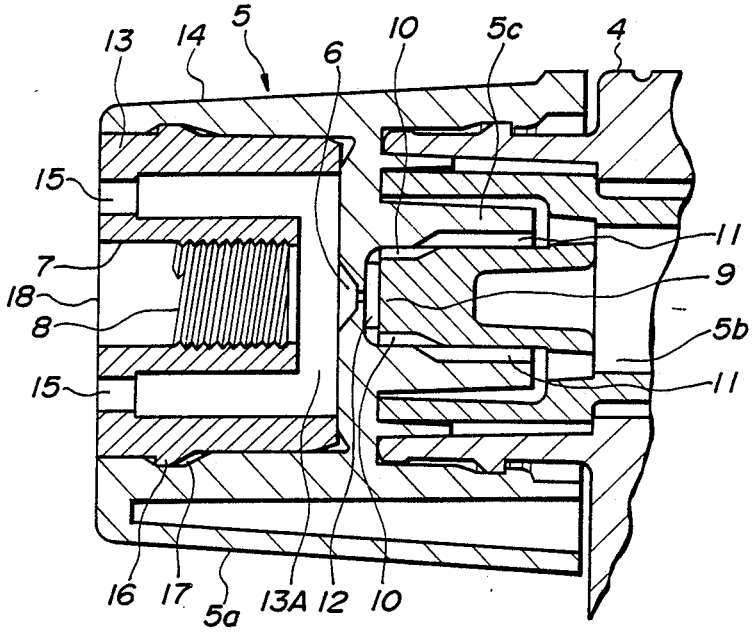
FIGS. 1(A) and 1(B) are longitudinal sectional view of an embodiment of a nozzle cap according to the present invention.
Figure 1B:
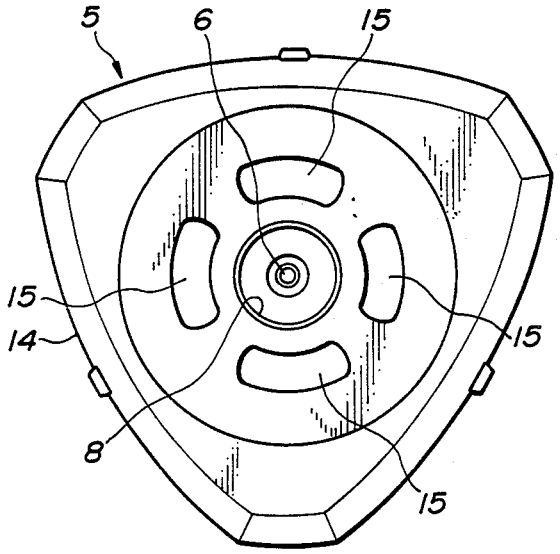

. FIGS. 1(A) and 1(B) show "foaming" position of the nozzle cap. Shallow grooves 10 are formed at a plurality of peripheral positions on the peripheral surface of the end of the plug 9 of the liquid guide **5*b* in a longitudinal direction from the front end face over a predetermined zone. Liquid passages 11 are formed at a plurality of peripheral positions on the inner periphery of an end cylindrical portion 5*c* in longitudinal line direction from the rear end face over a predetermined zone. A spin groove 12 is disposed at the rear side face of the nozzle port 6. At the "foaming" position, the shallow grooves 10, 10 communicate between the liquid passages 11, 11 and the spin groove 12 to thus inject high pressure liquid through the spin groove 12 and the nozzle port 6 in an atomized state to collide the atomized liquid to the inner peripheral wall of the foaming cylinder 7** to foam the liquid.

When the nozzle body **5*a* is rotated to the "direct" position, deep groove of different direction, not shown in the FIG. 1, of the plug 9 communicates the liquid passages 11, 11 directly with the nozzle port 6 to thus inject the high pressure nozzle directly in a water column state without spin from the nozzle port 6. When the nozzle body 5*a* is rotated to the "closure" position, the portion not formed with the shallow grooves 10, 10 and the deep groove of the plug 9 is disposed to interrupt between the liquid passages 11, 11, the nozzle port 6 and the spin groove 12** to shut off the communication thereamong.

The foaming cylinder 7 is integrally formed as an outer periphery thereof with a large-diameter mounting cylinder 13. The mounting cylinder 13 is engaged fixedly within a peripheral wall 14 projected toward the front face side so that the foaming cylinder 7 is arranged at an air gap 13A of suitable distance on the front face of the nozzle port 6 of the nozzle body **5*a***. The foaming cylinder 7 and the mounting cylinder 13 are integrated by a front end plate. Air intake openings 15 are perforated peripherally at the end plate and communicate with the air gap 13A. The foaming cylinder 7 also has an engaging projecting circumferential strip 16 formed on the outer peripheral surface of the mounting cylinder 13 to be engaged with an engaging inner circumferential groove 17 formed on the inner peripheral surface of the peripheral wall 14.

The inner peripheral uneven portion 8 on the inner peripheral wall of the foaming cylinder 7 is formed substantially on the half nearest the nozzle port 6 for colliding with injecting liquid from the nozzle port 6. The projecting strip is spirally projected on the inner wall to form the uneven state.

The inner peripheral uneven portion 8 of the foaming cylinder 7 may be formed in an uneven state on the inner wall of the foaming cylinder 7, and is not limited to the embodiment in FIG. 1.

Figure 2:
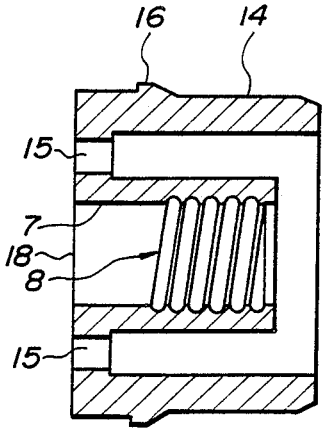
FIGS. 2 to 7 are longitudinal sectional views of the essential portions of different embodiments having various peripheral uneven portions.
Figure 3:
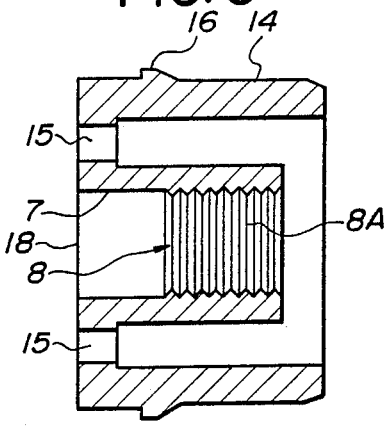
Figure 4:
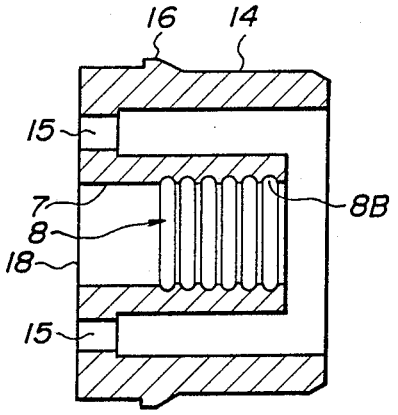
Figure 5:
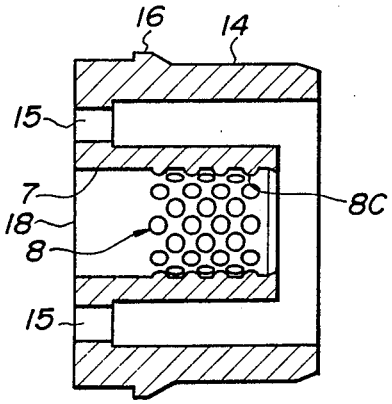
Figure 6:
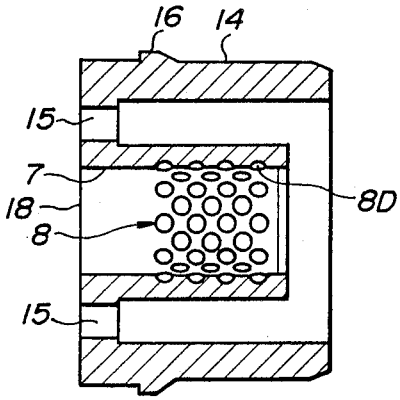
Figure 7:
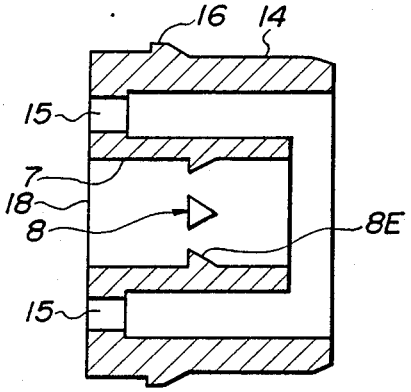

FIGS. 2 to 7 show different examples of inner peripheral uneven portions 8 of the foaming cylinder 7. In the example of FIG. 2, grooves are spirally recessed on the inner peripheral wall of the foaming cylinder 7 to form an uneven state on the inner peripheral wall. In the example of FIG. 3, a plurality of ring-like projecting strips 8A are peripherally projected on the inner peripheral wall of the foaming cylinder 7 to form an uneven state on the inner peripheral wall. In the example of FIG. 4, a plurality of ring-like peripheral grooves 8B are peripherally recessed on the inner peripheral wall of the foaming cylinder 7 to form an uneven state in the inner peripheral wall. In the example of FIG. 5, a plurality of projections 8C are projected on the inner peripheral wall of the foaming cylinder 7 to form an uneven state on the inner peripheral wall. In the example of FIG. 6, a plurality of recesses 8D are recessed on the inner peripheral wall of the foaming cylinder 7 to form an uneven portion on the inner peripheral wall. In the example of FIG. 7, small projections 8E of a triangular projecting shape are formed on a plane at predetermined circumferential intervals on the inner peripheral wall of the foaming cylinder 7 to form an uneven state on the inner peripheral wall.

When the nozzle body 5*a* is set to the "foaming" position, an angle for diffusing liquid (atomized state) injected from the nozzle port 6 depends differently upon the viscosity of the liquid to be injected. Therefore, the formation of the uneven portion 8 is preferably devised on the basis of the viscosity of the liquid to be injected.

Figure 8:
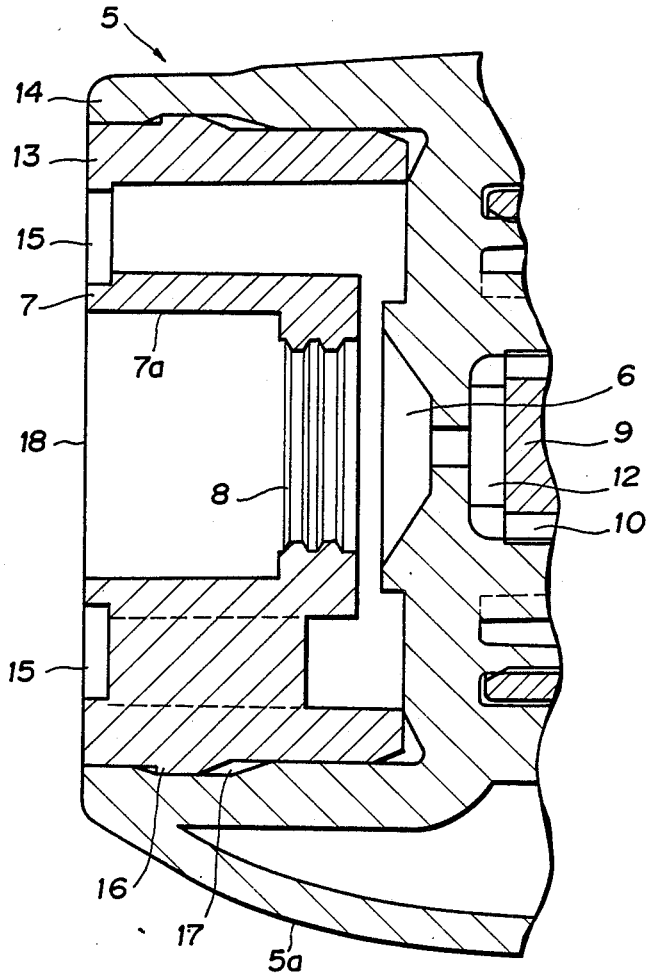
FIG. 8 is a sectional view of the essential portion of the embodiment in which the inner peripheral uneven portion is formed shortly in an axial direction and the inner diameter of the portion not formed with the uneven portion of the foaming cylinder is larger than the maximum inner diameter of the uneven portion.

In case of low viscosity liquid, the liquid is injected to be dispersed in a wide angle from the nozzle port 6. Thus, the injected liquid (atomized state) is diffused at the position near the nozzle port 6 axially as compared with the case of high viscosity liquid. Accordingly, when the foaming cylinders which have the uneven portions of the same shape are employed, a range that the low viscosity liquid is contacted with the uneven portion 8 becomes a peripheral surface near the nozzle port 6 on the inner peripheral wall of the foaming cylinder 7 as compared with that of the high viscosity liquid. Thus, in the case of low viscosity liquid, as shown in FIG. 8, it is desirable to form the uneven portion 8 shorter and nearer to the nozzle port 6 axially as compared with the case of high viscosity liquid. When the uneven portion 8 is formed too long in the axial direction in the foaming cylinder 7, the resistance of the uneven portion 8 against the liquid injected from the nozzle port 6 is increased so that the injecting pressure of the liquid injected from an injection port 18 decreases. For example, as shown in FIG. 8, the uneven portion 8 is formed on the portion near the side of the nozzle port 6 from the center of the inner peripheral wall of the foaming cylinder 7. When the foamablity is good and the viscosity of the liquid is low, foaming is performed efficiently even if the uneven portion 8 is formed shorter in the axial direction of the foaming cylinder 7.

On the other hand, in case of high viscosity liquid, the liquid is diffused and injected in a relatively narrow angle from the nozzle port 6 as compared with the case of low viscosity liquid. Thus, it is preferable to form the uneven portion 8 longer in the axial direction farther from the nozzle port 6.

Further, in order to reduce the resistance of the foaming cylinder 7 against the injected liquid in case of low viscosity liquid, as shown in FIG. 8, the inner diameter of the portion 7*a* formed with no uneven portion 8 of the foaming cylinder 7 may increased larger than the maximum inner diameter of the uneven portion 8. Thus, such configuration eliminates to increase the resistance of the inner wall portion 7*a* of the foaming cylinder 7 not formed with the uneven portion 8 so that the injecting pressure of the liquid from the injection port 18 increases. Also, the atomizing pattern can be varied.

Figure 9:
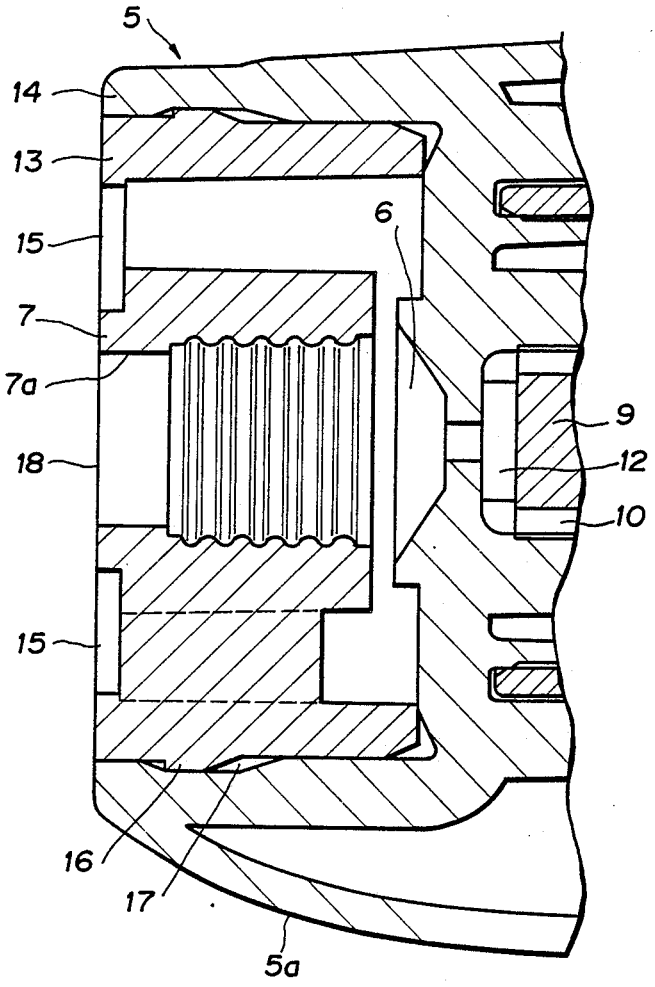
FIG. 9 is a sectional view of the essential portion of still another embodiment in which the inner diameter of the portion not formed with the uneven portion of the foaming cylinder is smaller than the minimum inner diameter of the uneven portion.

In case of high viscosity liquid, as shown in FIG. 9, the inner diameter of the portion 7*a* not formed with the uneven portion 8 of the foaming cylinder 7 may be formed smaller than the minimum inner diameter of the uneven portion 8. However, when the inner diameter of the portion 7*a* is excessively reduced, the resistance increases excessively to cause the injecting pressure of the liquid to reduce, thereby permitting the liquid to leak and drop from the injection port.

The uneven portion 8 of the inner peripheral wall of the foaming cylinder 7 is formed mainly on the rear half portion near the nozzle port 6 on the inner peripheral wall of the foaming cylinder 7 and it is preferable not to form the uneven portion 8 on the entire inner peripheral wall of the foaming cylinder 7. If the uneven portion 8 is formed on the entire inner peripheral wall of the foaming cylinder 7, the resistance against the injected liquid by the uneven portion 8 is excessively increased to reduce the injection pressure of the liquid. The axial length of the uneven portion 8 on the inner peripheral surface depends upon the viscosity of the liquid.

Figure 10:
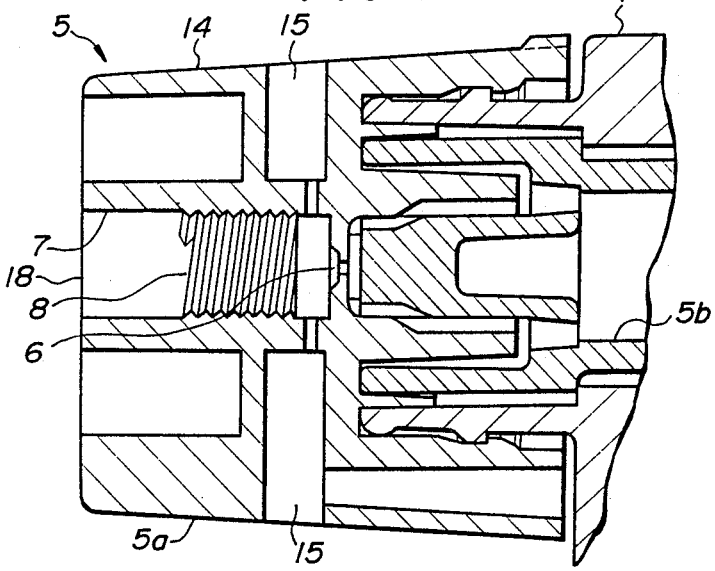
FIG. 10 is a longitudinal sectional view of the other embodiment in which a foaming cylinder 7 and a nozzle body **5*a* are integrally formed.
Figure 11:
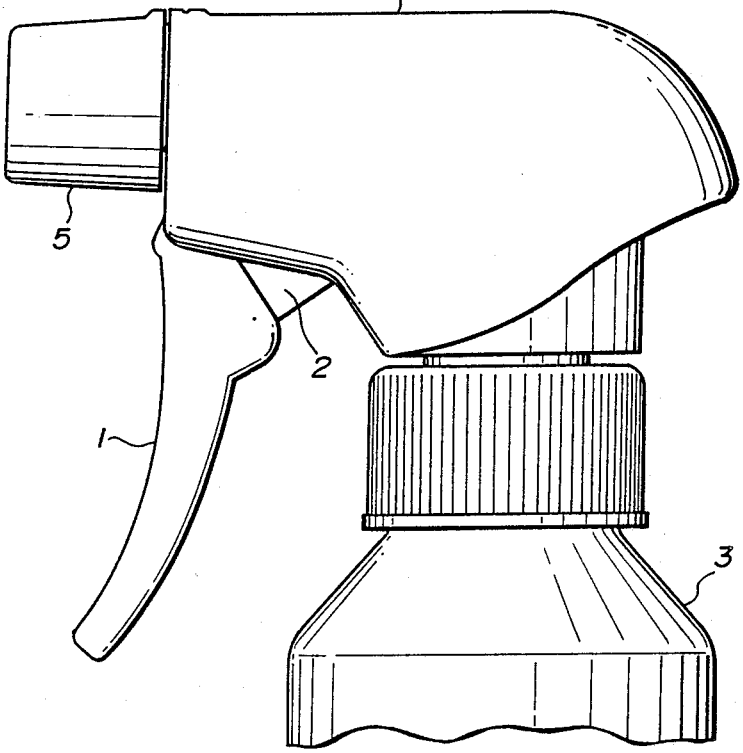
FIG. 11** is a schematic view of a conventional trigger type liquid dispenser.

In the embodiments described above, the foaming cylinder 7 is formed independently from the nozzle body 5*a*. However, the foaming cylinder 7 may be formed integrally with the nozzle body 5*a*. FIG. 10 shows the example of this case. A foaming cylinder 7 is projected integrally from the front wall of the outer periphery of the nozzle port. When the foaming cylinder 7 is integrally formed with the nozzle body 5*a*, if an air intake port 15 is formed on the front face of the nozzle cap, it cannot be removed from a mold after molding it in a casting mold. Therefore, in the embodiment of FIG. 10, an air intake port 15 is formed on the side of the nozzle cap.

The respective portions are molded of synthetic resin material.

According to the present invention as described above, the uneven portion 8 is formed on the inner peripheral wall of the foaming cylinder 7 so that the injecting liquid from the nozzle port 6 is complicatedly reflected by the uneven portion 8. Therefore, the nozzle cap having high foaming efficiency can be provided.

What is claimed is:

1. A nozzle cap comprising a nozzle body having a divergent nozzle port and a foaming cylinder attached to a nozzle body to be axially aligned and forward of said divergent nozzle port, said foaming cylinder further comprising an inner peripheral uneven portion formed on an inner peripheral wall of said foaming cylinder having a substantially uniform cross-sectional opening and an inner peripheral even portion defined by said inner peripheral wall of said foaming cylinder having a substantially uniform cross-sectional opening, said inner peripheral uneven portion of said foaming cylidner is adjacent to said divergent nozzle port so that liquid injected from the divergent nozzle port is dispersed outwardly and directly impinges on the adjacent uneven portion.

2. The nozzle cap according to claim 1, wherein said uneven portion is formed by spirally projecting a projecting strip on the inner peripheral wall of said foaming cylinder.

3. The nozzle cap according to claim 1, wherein said uneven portion is formed by spirally recessing a groove on the inner peripheral wall of said foaming cylinder.

4. The nozzle cap according to claim 1, wherein said uneven portion is formed by peripherally projecting a plurality of ring-like projecting strips on the inner peripheral wall of said foaming cylinder.

5. The nozzle cap according to claim 1, wherein said uneven portion is formed by peripherally recessing a plurality of ring-like grooves on the inner peripheral wall of said foaming cylinder.

6. The nozzle cap according to claim 1, wherein said uneven portion is formed by projecting a plurality of projections on the inner peripheral wall of said foaming cylinder.

7. The nozzle cap according to claim 1, wherein said uneven portion is formed by a plurality of recesses on the inner peripheral wall of said foaming cylinder.

8. The nozzle cap according to claim 1 wherein said uneven portion is formed by forming small projections of a triangular projecting shape at predetermined peripheral intervals on a circumferential plane of the inner peripheral wall of said foaming cylinder.

9. The nozzle cap according to claim 1, wherein when low viscosity liquid is injected, said uneven portion is formed on the inner wall nearest said divergent the nozzle port in an axial direction of said foaming clyinder and the length of said uneven portion is less than half the length of said foaming cylinder.

10. The nozzle cap according to claim 1, wherein when a low viscosity liquid is the material to be foamed, the inner cross-sectional opening of said even portion of said foaming cylinder is larger than the maximum inner cross-sectional opening of said uneven portion.

11. The nozzle cap according to claim 1, wherein when high viscosity liquid is injected, the uneven portion is formed over a substantial portion of the length of said foaming cylinder in an axial direction of said foaming cylinder.

12. The nozzle cap according to claim 1, wherein said nozzle body and said foaming cylinder are formed as one integrated part.

13. The nozzle cap according to claim 1, wherein when a high viscosity liquid is the material to be foamed, the inner cross-sectional opening of said even portion of said foaming cylinder is smaller than the minimum inner cross-sectional opening of said uneven portion.

* * * * *